United States Patent [19]

Nieman

[11] 4,243,093

[45] Jan. 6, 1981

[54] METHOD OF MAKING AN INSULATED MANIFOLD WITH DOUBLE CAST WALLS

[75] Inventor: John R. Nieman, Pekin, Ill.

[73] Assignee: Caterpillar Tractor Co., Peoria, Ill.

[21] Appl. No.: 852,378

[22] Filed: Nov. 17, 1977

[51] Int. Cl.[3] ..... B22D 19/16; B22D 19/00

[52] U.S. Cl. ..... 164/96; 164/9; 164/34; 164/45; 164/94; 164/95; 164/98; 164/112; 164/135

[58] Field of Search ..... 164/6, 9–11, 164/34–36, 45, 135, 93–96, 98, 112, 137, 27

[56] References Cited

U.S. PATENT DOCUMENTS

| | | | |
|---|---|---|---|
| Re. 28,988 | 10/1976 | Schleitlin et al. | 60/322 |
| 1,423,654 | 7/1922 | Engel, Sr. | 164/96 |
| 2,842,820 | 7/1958 | Brennan | 164/98 X |
| 3,157,924 | 11/1964 | Smith | 164/34 |
| 3,426,834 | 2/1969 | Jacobs et al. | 164/34 X |
| 3,949,552 | 4/1976 | Kaneko et al. | 60/282 |
| 4,077,458 | 3/1978 | Hayashi et al. | 164/9 X |

FOREIGN PATENT DOCUMENTS

| | | | |
|---|---|---|---|
| 2616040 | 10/1977 | Fed. Rep. of Germany | 164/112 |
| 39-13373 | 7/1964 | Japan | 164/112 |

*Primary Examiner*—Robert Louis Spruill
*Assistant Examiner*—Gus T. Hampilos
*Attorney, Agent, or Firm*—Wegner, Stellman, McCord, Wiles & Wood

[57] ABSTRACT

A composite article and method of forming the same wherein an inner casting is separated from an outer casting by an insulative portion defining the pattern for the outer surface of the inner casting and the pattern for the inner surface of the outer casting. The insulative portion is captured between the castings to define a thermal barrier therebetween. The castings are formed by gasifying an expendable gasifiable pattern corresponding to the inner and outer castings, respectively. The patterns are assembled with the insulative portion of the article disposed therebetween and a mold is formed about the assembled patterns and insulative portion. Upon pouring of molten casting metal into the mold, the expendable patterns are gasified into the mold, permitting the inner and outer portions of the article to be cast about the insulative portion to form the desired final composite article.

13 Claims, 5 Drawing Figures

FIG. 1
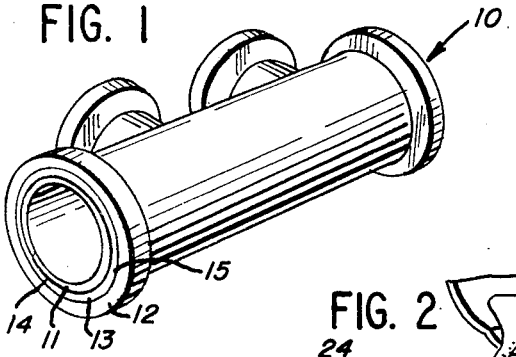
FIG. 3
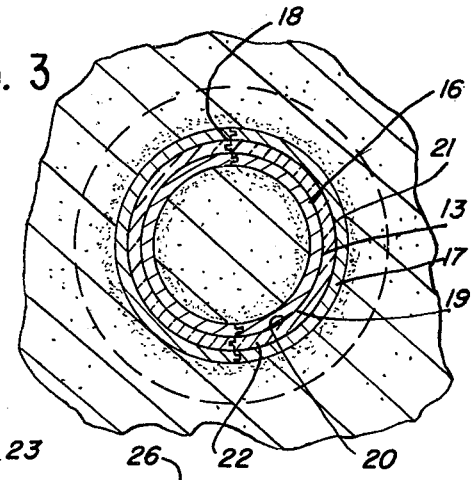
FIG. 2
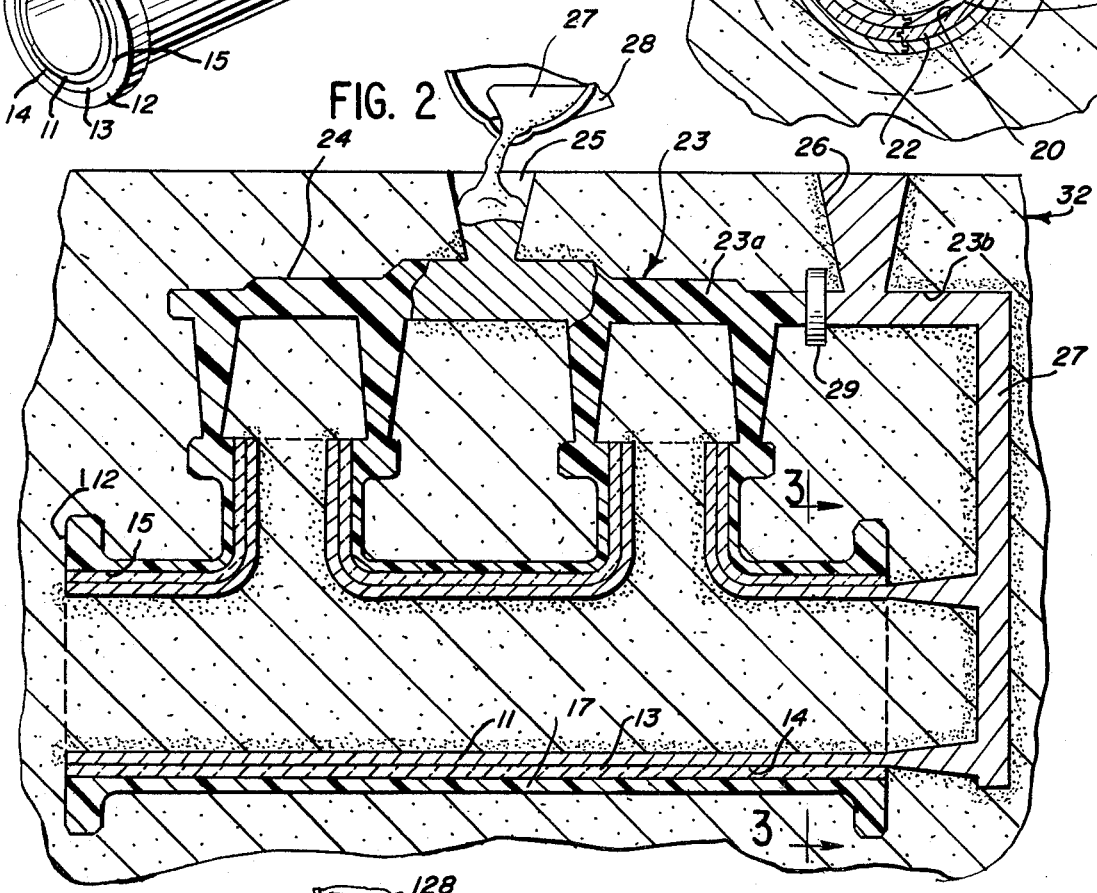
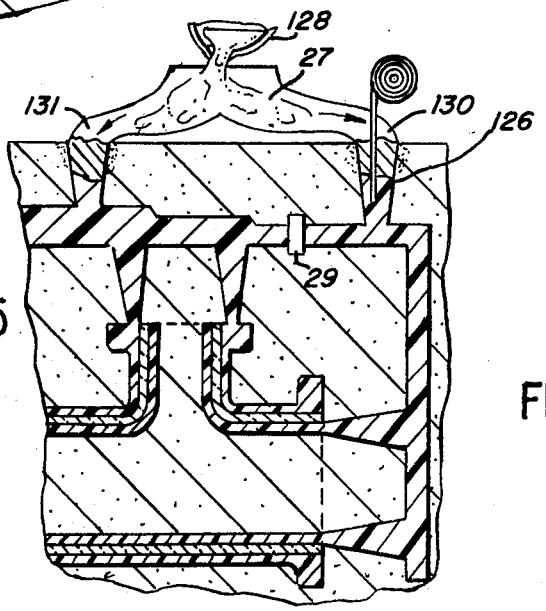
FIG. 5
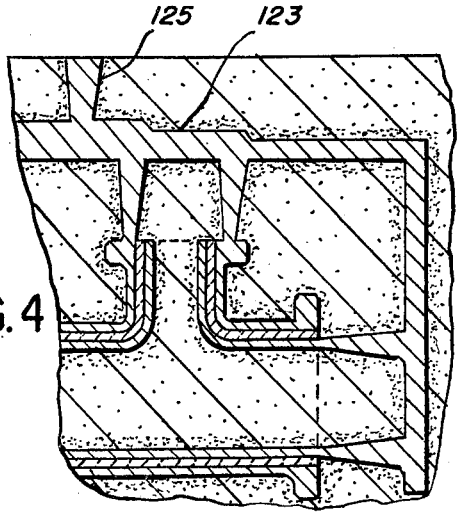
FIG. 4

METHOD OF MAKING AN INSULATED MANIFOLD WITH DOUBLE CAST WALLS

BACKGROUND OF THE INVENTION

1. Field of the Invention

This invention relates to cast articles and in particular to forming composite cast articles having insulating portions intermediate cast portions thereof.

2. Description of the Prior Art

In applications such as exhaust manifold applications, it is desirable to provide an insulative layer so as to reduce the exterior temperature of the manifold such as to 400° F. or less.

One conventional solution to the problem of providing such a low exterior temperature has been to utilize a water cooled manifold. This structure, however, has the disadvantage of increased cost and maintenance as well as in undesirably cooling the exhaust gases, thus preventing possible use of the thermal energy of the gases as with associated apparatus.

In one known form of manifold design, formed and welded sheet metal walls are provided with a formed inner layer of insulation material. In U.S. Pat. No. RE. 28,988 of George E. Scheitlin et al, such an exhaust gas manifold is disclosed wherein the insulating material comprises a layer of compressible material interposed between the inner and outer sheet metal sleeves.

As shown in U.S. Pat. No. 3,173,451 of Games Slayter, a cast manifold with liner may be provided wherein the manifold includes a layer of separate, particulate, highly refractory fibers and a refractory, inorganic binder, with a body of a cast metal bonded to the layer so as to have a portion of the cast metal extend partially into the layer. This structure requires that the binder have a melting point in excess of the melting point of the metal.

Yasuhisa Kaneko et al, in U.S. Pat. No. 3,949,552, show heat insulating castings adapted for use in parts of the exhaust system of an internal combustion engine as well as to other parts through which hot gases, liquid or powders may flow. The Kaneko et al castings comprise triple structure castings including a heat and corrosion resistant metal sheet with a heat insulating refractory material covering a significant portion of the sheet. A cast metal envelope is formed about the sheet and refractory material so as to sandwich the refractory material therebetween.

In U.S. Pat. No. 2,830,343, Harold F. Shroyer discloses a cavityless casting mold and method of making the mold wherein the pattern is provided in a mold body which is burnable by the cast metal as it is poured in so as to be replaced by the cast metal in forming the desired casting. Shroyer teaches the use of expanded plastics, such as polystyrene or polyethylene, as the pattern material.

As shown in U.S. Pat. No. 3,991,808 of John R. Nieman et al, which patent is owned by the assignee hereof, in one form of casting, control of the characteristics of the cast metal is provided by introducing an alloying material into the cast metal as it is poured into the mold. Thus, the alloying, or inoculating, material is maintained at molten form in the casting metal only for a short period of time until the casting metal cools, thereby providing improved reproducible control over the microstructure and final properties of the castings.

SUMMARY OF THE INVENTION

The present invention comprehends an improved insulative casting composite article and method of forming the same wherein both inner and outer cast portions are formed in situ at opposite sides of an insulative barrier member whereby the barrier member serves as a portion of the pattern of the castings and is retained therebetween in the final article.

In the illustrated embodiment, the castings are formed by gasifying an expendable gasifiable pattern juxtaposed to the insulative member with the assembly of the patterns and insulative member being provided in a suitable mold formed of suitable particulate material, such as sand, etc.

Both of the inner and outer portions of the composite article may be cast simultaneously, or they may be cast independently, as desired. The casting may be effected from the common source of molten metal where each of the inner and outer cast portions are to be formed of similar metal.

Where the inner and outer portions are to be cast of different metals, separate sprues and gates may be provided as desired.

Where the different metals differ solely in additive characteristics, the casting may be effected from a single source of molten metal with the metal flowing to one or both of the patterns having additive material added thereto as desired during the flow of the metal to the pattern.

The patterns may be preformed of suitable gasifiable material, and in the illustrated embodiment, each of the patterns is formed of a plurality of sections.

The assembly of the patterns and insulative portion may be provided with an outer refractory coating. The pattern portions may be adhesively joined prior to the application of the coating.

The castings and insulative portion of the composite article may be interlocked together to maintain the desired integrity of the article.

In the illustrated embodiment, the patterns are formed of styrofoam and the refractory coating is provided as an air-dried slurry.

The composite article and method of forming the same of the present invention are extremely simple and economical while yet providing the highly desirable insulative structure as discussed above.

BRIEF DESCRIPTION OF THE DRAWING

Other features and advantages of the invention will be apparent from the following description taken in connection with the accompanying drawing wherein:

FIG. 1 is a perspective view of a composite article embodying the invention;

FIG. 2 is a fragmentary vertical section of a mold provided with expendable patterns and intermediate insulative portions, the inner casting being shown as upon completion of the casting process and the outer casting being shown as being formed by the delivery of molten metal through the sprue and gate associated therewith;

FIG. 3 is a fragmentary section taken substantially along the line 3—3 of FIG. 2;

FIG. 4 is a fragmentary vertical section illustrating the method of forming the composite article wherein a common source of molten metal is utilized to provide the casting material to form both inner and outer casting portions; and FIG. 5 is a fragmentary vertical section illustrating a modified method of forming the composite article wherein a common source of molten metal is utilized, but wherein one of the streams is provided with additive material prior to the delivery thereof to one of the patterns.

DESCRIPTION OF THE PREFERRED EMBODIMENT

In the exemplary embodiment of the invention as disclosed in the drawing, a composite article generally designated 10 is shown to comprise an inner cast portion 11, an outer cast portion 12, and an intermediate insulative portion 13. In the article 10, the insulative portion 13 effectively defines the pattern for the outer surface 14 of the inner cast portion 11 and the pattern for the inner surface 15 of the outer cast portion 12. Thus, as shown in FIG. 2 of the drawing, the arrangement is such that the cast portions are interlocked together automatically with the insulative portion 13 locked in facial engagement with each of the inner and outer case portions to define an effectively laminated insulated casting.

As shown in FIG. 2, the patterns for forming the composite cast article may include an inner expendable gasifiable pattern 16 and an outer expendable gasifiable pattern 17. As shown in FIG. 3, the patterns and insulative portion are snugly assembled and may be formed in a plurality of separate parts joined by suitable interlocking portions 18 which may be adhesively secured as desired. Thus, the outer surface 19 of the inner pattern 16 is facially juxtaposed to the inner surface 20 of the insulative layer 13 and the outer surface 21 of the insulative layer is facially juxtaposed to the inner surface 22 of the outer pattern 17.

Upon completion of the assembly, including the gating portion 23, such as illustrated in FIG. 2, the entire assembly may be coated with a suitable refractory slurry which may be air-dried to form a thin refractory coating 24 on the assembly.

The coated assembly may then be placed in a suitable mold box and surrounded with a flowable mold material, such as sand or metal shot, adapted to flow under vibration to provide a high density, uniform particulate mold 32 about the assembly, as shown in FIG. 2. As shown, the top of the gate portion 23 at 25 and 26 may define entrance portions into which casting metal 27 may be poured from a suitable crucible 28, in the conventional manner.

In the embodiment of FIG. 2, a dam 29 may be provided to separate the gate 23 into a first portion **23*a* for delivering cast metal to the outer pattern 17 and a second portion 23*b* for delivering the molten metal to the inner pattern 16. In the illustration of FIG. 2, the casting process relative to the inner portion of the casting has been completed with the cast metal 27 extending throughout the pattern space. In effecting such casting, the incoming molten casting metal gasifies the gate and pattern material so as to drive it into the surrounding mold sand, or other particulate material, as described in the above-mentioned Shroyer U.S. Pat. No. 2,830,343. The gasifying of the expendable pattern material, such as in the gate portion 23*a*, is illustrated in FIG. 2 adjacent the upper gate portion 25**.

In the illustrated embodiment, the pattern and gate material may be formed of the same material, and illustratively may comprise styrofoam. The styrofoam may be accurately formed into the desired pattern configuration and, thus, offers a low cost, accurate method of providing the desired manifold cast portions.

Upon completion of the casting of both metal portions of the composite article and cooling thereof, the mold box may be broken open and the mold particulate material removed, permitting the gate portions to be removed from the article in the conventional manner, thereby completing the forming of the article, as shown in FIG. 1. As a result of the configuration of the article, the cast portions are intermittently interlocked with the insulative portion to provide a permanent, unitary assembly.

As indicated briefly above, where the metal forming both the inner and outer cast portions of the article is similar, the gate may be provided with a single inlet portion, such as inlet portion 125 of gate portion 123, illustrated in FIG. 4.

Further, as illustrated in FIG. 5, the pouring of the molten metal to both the inner and outer patterns may be effected simultaneously. Where the metal of one of the portions is to differ from that of the other portion as by the inclusion of additives or alloying material, such additives or alloying material may be added to the stream 130 of the molten metal 27 as it is flowing inwardly through gate 126 from a common source 128. Thus, in the embodiment of FIG. 5, the inner and outer cast portions are effectively formed of metals having different characteristics while yet being formed simultaneously from a common supply of casting metal. As will be obvious to those skilled in the art, different additives may be provided to each of the streams 130 and 131 if desired.

The embodiments of FIGS. 4 and 5 are similar to that of the embodiment of FIGS. 1–3 in all other respects.

The material of which the insulative portion is formed and the thickness thereof may be suitably preselected to provide the desired temperature reducing effect.

The foregoing disclosure of specific embodiments is illustrative of the broad inventive concepts comprehended by the invention.

The embodiments of the invention in which an exclusive property or privilege is claimed are defined as follows:

1. A method of forming a thermal insulating composite article having an inner cast metal portion, an outer cast metal portion, and an intermediate thermally insulating wall, comprising the steps of:

forming an expendable gasifiable pattern of said inner portion;

forming an expendable gasifiable pattern of said outer portion;

assembling said inner and outer portions with a non-gasifiable portion defined by an insulative wall snugly received and supported therebetween to define an integral assembly wherein the insulative wall is accurately positioned solely by the supporting patterns;

providing a mold about said assembly; and pouring molten casting metal into said mold from opposite sides of said insulative wall to gasify said patterns in said mold and form said inner and outer cast metal portions in facial engagement respectively with the inwardly and outwardly facing surfaces of the pattern defined by said insulative wall, said insulative wall being effectively maintained accurately in the desired intermediate disposition by the ungasified portion of both patterns and the incoming metal during the pouring operation to define an effective thermal insulation barrier between said cast metal portions of the resultant composite article.

2. The method of forming a composite article of claim 1 wherein said inner portion is cast of a metal different from that of said outer portion.

3. The method of forming a composite article of claim 1 wherein said metal portions are cast sequentially.

4. The method of forming a composite article of claim 1 wherein said cast portions are cast concurrently.

5. The method of forming a composite article of claim 1 wherein each of said patterns includes sprue, gating, and vent passage portions.

6. The method of forming a composite article of claim 1 wherein each of said patterns is formed of a plurality of sections.

7. The method of forming a composite article of claim 1 wherein said insulative portion is preformed and installed in association with one of said patterns prior to the assembly of the other pattern therewith.

8. The method of forming a composite article of claim 1 wherein said insulative wall is provided about said inner pattern prior to the assembly of said outer pattern thereabout.

9. The method of forming a composite article of claim 1 wherein said insulative wall is provided in a plurality of sections about said inner pattern prior to the assembly of said outer pattern thereabout.

10. The method of forming a composite article of claim 1 wherein a source of molten casting metal is provided and delivered to said patterns along separate paths, said method including the step of introducing material into the metal as it is being delivered to one of said patterns to cause the cast portion formed thereby to have different metallurgical characteristics from those of the metal forming the other cast portion.

11. The method of forming a composite article of claim 1 wherein said assembly of the patterns and insulation wall is provided with an outer refractory coating.

12. The method of forming a composite article of claim 1 wherein said patterns are formed of a plurality of sections adhesively joined.

13. The method of forming a composite article of claim 1 wherein said insulative wall comprises a plurality of preformed sections adhesively joined.

* * * * *